US012221883B1

(12) United States Patent
Wang et al.

(10) Patent No.: US 12,221,883 B1
(45) Date of Patent: Feb. 11, 2025

(54) COMPACT APPARATUS FOR QUICK CORE FLOOD TESTS AND METHOD OF USE

(71) Applicant: SAUDI ARABIAN OIL COMPANY, Dhahran (SA)

(72) Inventors: Jinxun Wang, Dhahran (SA); Ming Han, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/407,919

(22) Filed: Jan. 9, 2024

(51) Int. Cl.

| | |
|---|---|
| ***E21B 49/02*** | (2006.01) |
| ***E21B 25/00*** | (2006.01) |
| ***E21B 49/00*** | (2006.01) |
| ***E21B 49/08*** | (2006.01) |

(52) U.S. Cl.
CPC ..... *E21B 49/02* (2013.01); *E21B 25/005* (2013.01); *E21B 49/008* (2013.01); *E21B 49/0875* (2020.05); *E21B 2200/20* (2020.05); *E21B 2200/22* (2020.05)

(58) Field of Classification Search
CPC .... E21B 49/02; E21B 49/0875; E21B 25/005; E21B 49/008; E21B 2200/20; E21B 2200/22
See application file for complete search history.

(56) References Cited

U.S. PATENT DOCUMENTS

| | | | | |
|---|---|---|---|---|
| 4,599,891 | A | 7/1986 | Brauer et al. | |
| 4,753,107 | A | 6/1988 | Reed et al. | |
| 8,356,510 | B2 | 1/2013 | Coenen | |
| 2012/0310614 | A1* | 12/2012 | Beattie | E21B 43/16 703/10 |
| 2013/0248176 | A1* | 9/2013 | Sunde | E21B 43/16 166/270.1 |
| 2015/0268314 | A1 | 9/2015 | Peterson | |
| 2016/0025895 | A1* | 1/2016 | Ziauddin | G01V 20/00 702/11 |
| 2018/0149004 | A1* | 5/2018 | Rao | E21B 43/164 |
| 2018/0335374 | A1 | 11/2018 | Kanj et al. | |
| 2020/0110192 | A1* | 4/2020 | Al Hashim | G01R 33/50 |
| 2020/0271563 | A1 | 8/2020 | Chen et al. | |
| 2021/0302280 | A1* | 9/2021 | Al-Qasim | G01N 1/31 |
| 2022/0091091 | A1 | 3/2022 | Hakimuddin | |
| 2022/0154563 | A1* | 5/2022 | AlYousif | C09K 8/5083 |
| 2022/0290540 | A1* | 9/2022 | Al Shalabi | E21B 43/16 |

(Continued)

*Primary Examiner* — Shane Bomar
(74) *Attorney, Agent, or Firm* — Osha Bergman Watanabe & Burton LLP

(57) ABSTRACT

A method includes acquiring a core sample from a first reservoir of interest that is producing hydrocarbons at a first recovery rate. The method includes performing a coreflooding study using a core flood apparatus. The coreflooding study includes a plurality of coreflooding simulations using the core sample disposed in the core flood apparatus. The method includes performing a reservoir simulation study on the first reservoir using a coreflooding simulation model and using the coreflooding study. The method includes adjusting a core flood fluid based on the reservoir simulation study to form an adjusted treatment fluid that produces a second recovery rate from the first reservoir. The second recovery rate may be greater than the first recovery rate. The method includes using an injection well and the adjusted treatment fluid for performing an injection operation of a reservoir.

23 Claims, 7 Drawing Sheets

(56) References Cited

U.S. PATENT DOCUMENTS

| | | | | |
|---|---|---|---|---|
| 2022/0307356 | A1* | 9/2022 | Hou | C09K 8/588 |
| 2023/0212943 | A1* | 7/2023 | Wang | G01N 15/0826 166/250.02 |
| 2024/0141766 | A1* | 5/2024 | Hou | E21B 43/20 |
| 2024/0201064 | A1* | 6/2024 | Wang | G01N 15/0806 |

* cited by examiner

COMPACT APPARATUS FOR QUICK CORE FLOOD TESTS AND METHOD OF USE

BACKGROUND

A coreflood test is conducted in a laboratory and a fluid or combination of fluids is injected into a sample of rock to observe interactions between the fluid and the rock. The core material comes from an oil reservoir, an outcrop rock, or other rock. Test conditions may be conducted at ambient temperature and low confining pressure or at high temperature and pressure to match that of a subject reservoir. Pressures and flow rates at both ends of the core are measured. The injected fluids may include chemicals used in the oil field. A coreflood is typically used to determine the optimum development option for an oil reservoir and often helps evaluate the effect of injecting fluids specially designed to improve or enhance oil recovery.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a method that includes acquiring a core sample from a first reservoir of interest that is producing hydrocarbons at a first recovery rate, the performing a coreflooding study using a core flood apparatus. The coreflooding study includes a plurality of coreflooding simulations using the core sample disposed in the core flood apparatus. The method includes a control system automatically performing a reservoir simulation study on the first reservoir using a coreflooding simulation model and using the coreflooding study. The method includes a control system automatically adjusting a core flood fluid based on the reservoir simulation study to form an adjusted treatment fluid that produces a second recovery rate from the first reservoir. The second recovery rate is greater than the first recovery rate. The method includes using an injection well and the adjusted treatment fluid and performing an injection operation of a reservoir.

This disclosure presents, in accordance with one or more embodiments, an apparatus that includes a confining chamber defined by a chamber inner wall of a core holder body, a conformable sleeve, a core end plug sealingly coupled to the core holder body and to the conformable sleeve, and a second end cap sealingly coupled to the core holder body. The core end plug is configured to couple to a sleeve first end of the conformable sleeve. The conformable sleeve is configured to hold a core sample from a first reservoir of interest such that a core outer surface-surface contact is formed with a sleeve inner surface and a core outer surface. The conformable sleeve includes a core piston configured for a sliding fit within the conformable sleeve. The core piston is inserted into the conformable sleeve from a sleeve second end such that a core end surface-surface contact is formed with a core piston surface. The apparatus includes a fluid cell defined by a cell inner wall of a cell body and a first end cap configured to sealingly couple to the cell body. The fluid cell is configured to sealingly couple to the confining chamber. The apparatus includes a piston translatably disposed in the fluid cell and configured to sealingly divide the fluid cell into a treatment fluid cell and a hydraulic chamber. The apparatus includes a translatable tube coupled to the core piston and configured for a sealing fit between the translatable tube and the second end cap. The apparatus includes a monitoring subsystem coupled to the confining chamber, the hydraulic chamber, and the treatment fluid cell. The monitoring subsystem is configured for recording coreflooding simulation data. The apparatus includes a communication interface coupled to the monitoring subsystem. The apparatus includes a processor coupled to the monitoring subsystem and the communication interface. The apparatus includes and a memory coupled to the processor. The memory includes instructions configured to perform a method including: obtain a command to generate the coreflooding simulation data; generate the coreflooding simulation data; and transmit the coreflooding simulation data using the communication interface.

This disclosure presents, in accordance with one or more embodiments, a system that includes a core flood apparatus including a core holder, a communication interface, a processor, and a memory. The core flood apparatus is configured for holding, using the core holder, a core sample acquired from a first reservoir of interest. The first reservoir is producing hydrocarbons at a first recovery rate. The system includes a control system coupled to the core flood apparatus. The control system includes a computer processor. The control system includes functionality for a method that includes performing, by the core flood apparatus, a coreflooding study including a plurality of coreflooding simulations using the core sample disposed in the core flood apparatus. The method includes performing, by the control system and using a coreflooding simulation model, a reservoir simulation study on the first reservoir using the coreflooding study. The method includes adjusting, by the control system, a core flood fluid based on the reservoir simulation study to form an adjusted treatment fluid that produces a second recovery rate from the first reservoir. The second recovery rate is greater than the first recovery rate. The method includes performing, using an injection well, an injection operation of a reservoir using the adjusted treatment fluid. The communication interface is configured to transmit coreflooding simulation data to the control system and the memory is configured to store the coreflooding simulation data.

In light of the structure and functions described above, embodiments disclosed herein may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
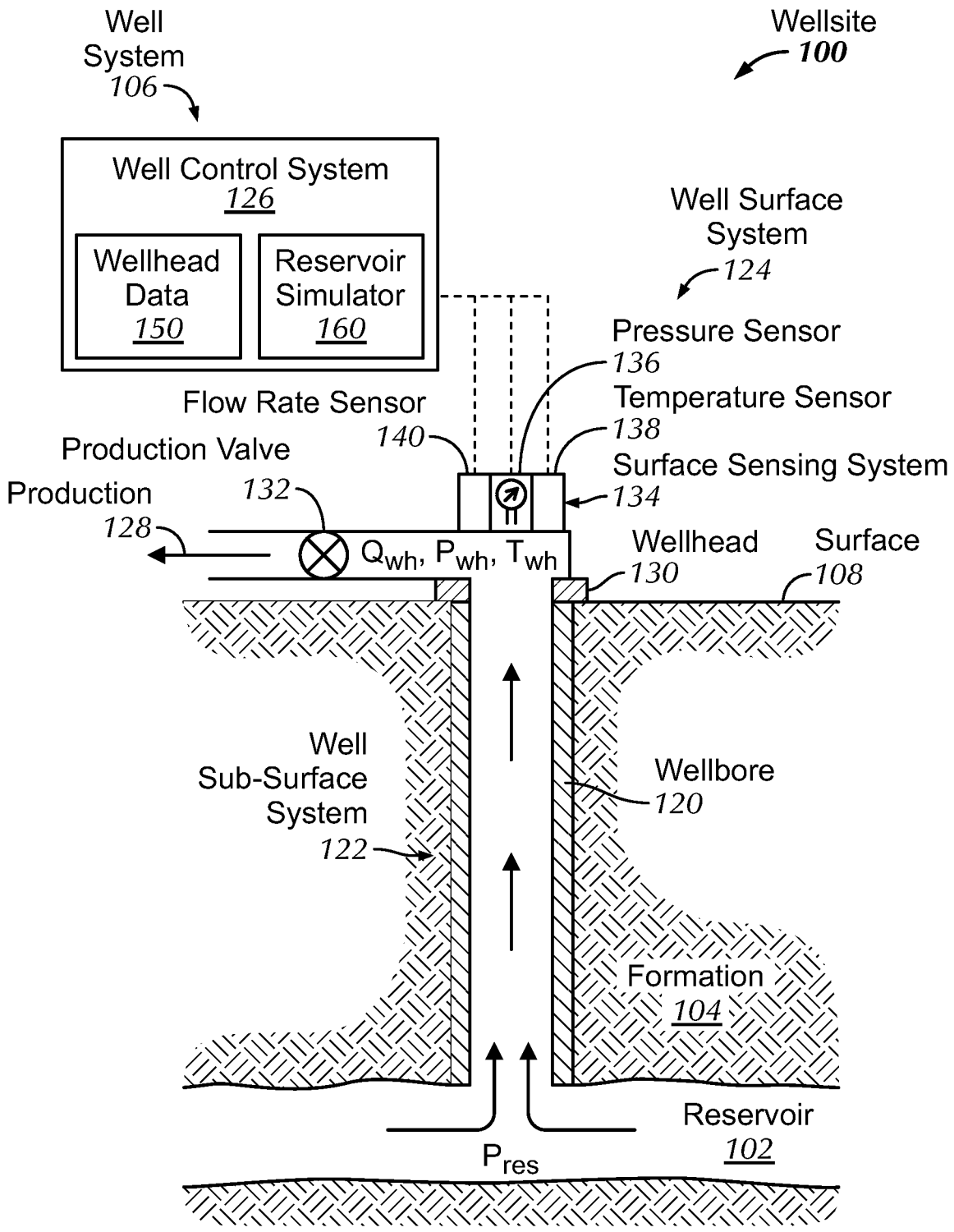
FIGS. 1, 2, 3, and 4 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. In the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. Measured depth (MD) is the length of the wellbore. True vertical depth (TVD) is the vertical distance from a point in the well at a location of interest to a reference point on the surface.

A producing zone of a reservoir is the zone containing hydrocarbons that are economically producible. The reservoir is marked with geological markers to drill the wellbore into the producing zone for optimal production and reservoir coverage. The geological layers may be characterized by the angle of the geological layers. Core samples may be acquired to characterize the geological and geophysical parameters in a coreflooding study. The parameters may be used to determine a treatment fluid such as an injection fluid for use in producing from the well using techniques such as waterflooding, enhanced oil recovery (EOR), and formation damage mitigation.

A coreflooding study is one of many crucial methods to evaluate, in a laboratory setting, each of many candidate injection fluids, i.e., test fluids or core flood fluids. The coreflooding study investigates an interaction between a core flood fluid and a core sample. The interaction may be affected by several test factors such as environmental parameters (e.g., pressure, temperature), core sample parameters (e.g., porosity), and core flood fluid parameters (e.g., chemical formulation or chemical blend, injection pressure.) The study detects the interaction and compares the interaction with a desired outcome, e.g., a predetermined criterion of a set of predetermined criteria. The comparison result may be that the interaction satisfies the predetermined criteria (or a criterion of the criteria). The result may be that the interaction fails to satisfy the predetermined criterion.

Depending on the results of the comparison the test factors may be adjusted. For example, the control system may determine whether a first coreflooding simulation satisfies a predetermined criterion. If the first coreflooding simulation fails to satisfy the predetermined criterion, then the control system may determine replacement simulation parameters for the coreflooding simulation test. For example, for a predetermined reservoir, the rock characteristics, the downhole pressure, and the downhole temperature are functions of the reservoir and may not be adjustable. The chemical formulation of the treatment fluid may be adjusted to evaluate its performance by observing its interaction with the rock at the given pressures and temperatures. The injection pressure and flowrate of the treatment fluid may also be adjusted to observe their impacts on the interactions and thus the performance. Together the core fluid parameters of formulation, pressure, and flowrate may be adjusted and the test repeated. The test may be terminated if the interaction does not meet the predetermined criteria, i.e., if the coreflooding simulation fails to satisfy the predetermined criterion.

The coreflooding study may investigate the interaction within a core flood apparatus containing the core flood fluid and the core sample. The core flood apparatus may be disposed in a core flood study system (e.g., a coreflooding system) used for performing the coreflooding study. The coreflooding system may include the core flood apparatus and various computer systems, computer processors, sensors, electrical power supplies, electrical wiring harnesses, pumps, fluids, and plumbing. The various components of the coreflooding system may be subjected to environmental conditions such as heating and cooling using, for example, a heating jacket or a cooling sleeve.

The coreflooding study provides essential input for development designs and performance predictions. For instance, a chemical flooding project may start with a series of laboratory studies to screen some candidate formulations of candidate injection fluids. Each candidate injection fluid may be tested one or more times. The candidate injection fluid, i.e., a core fluid, used for each test is known as a test fluid. Coreflooding studies, injecting test fluids to the core samples from a target reservoir, is then performed to validate and optimize the formulas in core scale. The experimental results provide essential input parameters for numerical reservoir simulation studies, which are employed to evaluate the field-scale performance and optimize injection strategies. Finally, the optimized formula is then deployed for field application. Examples of commonly conducted coreflooding studies are waterflooding, enhanced oil recovery (EOR), and formation damage evaluations.

The coreflooding experiment is conducted to simulate the fluid flow through reservoir formations using representative core samples. It usually requires a complex coreflooding system for the test, and it is time consuming to conduct the coreflooding experiment. Some projects may even require many coreflooding tests for evaluating injection fluids or providing essential data. Sometimes, it is also a challenge to obtain adequate sample size, or to prepare a regular cylindrical shape. A simplified method to study the fluid flow through porous media is to perform the test using fabricated micromodels (or microfluidic chips). However, the porous media involved in these tests are far from representative of the pore systems of actual reservoir rocks. Thus, it is desirable to conduct the core flood tests using more convenient setup and smaller core samples than the conventional tests.

In general, embodiments of the disclosure include systems and methods for a compact apparatus using smaller core sample for rapid coreflooding evaluation tests. There is a need for rapid evaluation of injection fluids for oil recovery potentials in the petroleum industry. There are some cases of oilfield developments for conventional corefloods in which there are no adequate sizes of core or there is no adequate amount of test fluid, e.g., a candidate treatment fluid. Micromodel tests are an option for evaluating treatment fluids, but are mainly used for observing the mechanisms of fluid flow in porous media, and the two-dimensional porous media are far less representative of reservoir rocks.

The conventional coreflooding tests require complicated setups including, in a conventional coreflooding test system, at least one core holder, several cylinders for injection fluids, many flow control valves all of which are built in a large oven, plus long tubes for pressurization. The long tubes are required for connecting the flow paths, and the tube lengths introduce large dead volumes in the system. The conventional core holders require larger-sized and regular-shaped (conventional shape) core plug samples. Larger volumes of fluids may also be needed when the pore volume of the core is larger. It is time-consuming to conduct coreflooding experiments, especially when a project such as a coreflooding study requires conducting many individual coreflooding tests.

The compact apparatus is a core flood test apparatus (hereafter a test apparatus) that integrates a core sample holder with an injection fluid cell, and the core sample holder can accommodate smaller-sized and irregular-shaped core plug (cylindrical rock) samples In comparison with the conventional coreflooding test system, the test apparatus integrates the core sample holder with the injection fluid cell thereby reducing the quantity of flow control valves and long connecting tubes, thus significantly reducing the dead volumes. In contrast with the conventional coreflooding test system which requires a large oven, the test apparatus may include a heating jacket for temperature control with the heating jacket covering both the core holder and the injection fluid. The test apparatus may help significantly reduce equipment cost as well as working space. In comparison with the conventional coreflooding test system, rock samples used for the tests in the test apparatus can be smaller than the conventional coreflooding tests, while still much larger and more representative than the porous media of micromodels. The smaller-sized core samples can be trimmed from small end pieces of regular cores. Small core pore volumes allow the rapid evaluations. In general, the disclosed test apparatus has the advantages of convenience, rapid evaluation, and cost effectiveness.

The disclosed test apparatus can accommodate smaller-sized and irregular-shaped core samples instead of the larger-sized and regular-shaped core samples used in conventional coreflooding test systems can be used the test apparatus. The commonly used core samples have diameter of 1.5 inches (3.81 cm) or 1.0 inch (2.54 cm) with length longer than 1.0 inch (2.54 cm). The smaller core samples for the test apparatus, for example, can have dimensions of 1.0 cm in diameter and 1.0 cm in length. The small samples can be trimmed from end pieces of core samples when cores of regular sample sizes are not available. As long as the rubber sleeve (e.g., the core sleeve) can hold the core sample, certain irregularity in the core sample can also be accommodated in the test apparatus. Smaller core samples have smaller pore volumes, which help accelerate the evaluation process. For example, fluid injectivity can be conveniently evaluated by injecting large pore volumes of test fluid (e.g., a candidate treatment fluid) to a small core sample. When designing chemical solutions, e.g., a coreflood fluid formula, for improving oil recovery, e.g., to form an optimized treatment fluid, the disclosed system and method may be used to rapidly validate the formulations by evaluating the oil recovery potential using the candidate chemicals.

FIG. 1 shows a schematic diagram in accordance with one or more embodiments. As shown in FIG. 1, FIG. 1 illustrates a wellsite 100 that includes a hydrocarbon reservoir (e.g., reservoir 102) located in a subsurface hydrocarbon-bearing (e.g., formation 104) and a well system 106. The formation 104 may include a porous or fractured rock formation that resides underground, below the surface of the earth or below a seabed (hereafter surface e.g., surface 108). In the case of the well system 106 being a hydrocarbon well, the reservoir 102 may include a portion of the formation 104. The formation 104 and the reservoir 102 may include different layers of rock having varying characteristics, such as varying degrees of permeability, porosity, and resistivity. In the case of the well system 106 being operated as a production well, the well system 106 may facilitate the extraction of hydrocarbons from the reservoir 102.

In some embodiments, the well system 106 includes a wellbore 120, a well sub-surface system 122, a well surface system 124, and a well control system 126. The well control system 126 may control various operations of the well system 106, such as well production operations, well completion operations, well maintenance operations, and reservoir monitoring, assessment, and development operations. In some embodiments, the well control system 126 includes a computer system that is the same as or similar to that of computer system described below in FIG. 7 and the accompanying description.

The wellbore 120 may include a bored hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "downhole" end of the wellbore 120. The wellbore 120 may facilitate the circulation of drilling fluids during drilling operations, the flow of hydrocarbon (e.g., oil and gas) production (e.g., production 128) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In some embodiments, during operation of the well system 106, the well control system 126 collects and records wellhead data 150 for the well system 106 and other data regarding downhole equipment and downhole sensors (e.g., using an automatic computer-controlled management system described herein.) The wellhead data 150 may include, for example, a record of measurements of wellhead pressure (P) (e.g., including flowing wellhead pressure (FWHP)), wellhead temperature (T) (e.g., including flowing wellhead temperature), wellhead production rate (Q) over some or all of the life of the well system 106, and water cut data. In some embodiments, the measurements are recorded in real-time, and are available for review or use within seconds, minutes or hours of the condition being sensed (e.g., the measurements are available within 1 hour of the condition being sensed). In such an embodiment, the wellhead data 150 may be referred to as "real-time" wellhead data. Real-time wellhead data may enable an operator of the well system 106 to assess a relatively current state of the well system 106, and to make real-time decisions regarding development of the well system 106 and the reservoir 102, such as on-demand adjustments in regulation of production flow from the well.

With respect to water cut data, the well system 106 may include one or more water cut sensors. For example, a water cut sensor may be hardware and/or software with functionality for determining the water content in oil, also referred to as "water cut." Measurements from a water cut sensor may be referred to as water cut data and may describe the ratio of water produced from the wellbore 120 compared to the total volume of liquids produced from the wellbore 120. In some embodiments, a water-to-gas ratio (WGR) is determined using a multiphase flow meter. For example, a multiphase flow meter may use magnetic resonance information to determine the number of hydrogen atoms in a particular fluid flow. Since oil, gas and water all contain hydrogen atoms, a multiphase flow may be measured using magnetic resonance. In particular, a fluid may be magnetized and subsequently excited by radio frequency pulses. The hydrogen atoms may respond to the pulses and emit echoes that are subsequently recorded and analyzed by the multiphase flow meter.

In some embodiments, the well surface system 124 includes a wellhead 130. The wellhead 130 may include a rigid structure installed at the "up-hole" end of the wellbore 120, at or near where the wellbore 120 terminates at the surface 108. The wellhead 130 may include structures for supporting (or "hanging") casing and production tubing extending into the wellbore 120. Production 128 may flow through the wellhead 130, after exiting the wellbore 120 and the well sub-surface system 122, including, for example, the casing and the production tubing. In some embodiments, the well surface system 124 includes flow regulating devices that are operable to control the flow of substances into and out of the wellbore 120. For example, the well surface system 124 may include one or more of a production valve 132 that are operable to control the flow of production 128. For example, a production valve 132 may be fully opened to enable unrestricted flow of production 128 from the wellbore 120, the production valve 132 may be partially opened to partially restrict (or "throttle") the flow of production 128 from the wellbore 120, and production valve 132 may be fully closed to fully restrict (or "block") the flow of production 128 from the wellbore 120, and through the well surface system 124.

Keeping with FIG. 1, in some embodiments, the well surface system 124 includes a surface sensing system 134. The surface sensing system 134 may include sensor devices for sensing characteristics of substances, including production 128, passing through or otherwise located in the well surface system 124. The characteristics may include, for example, pressure, temperature, and flow rate of production 128 flowing through the wellhead 130, or other conduits of the well surface system 124, after exiting the wellbore 120.

In some embodiments, the surface sensing system 134 includes a surface pressure sensor 136 operable to sense the pressure of production 128 flowing through the well surface system 124, after it exits the wellbore 120. The surface pressure sensor 136 may include, for example, a wellhead pressure sensor that senses a pressure of production 128 flowing through or otherwise located in the wellhead 130. In some embodiments, the surface sensing system 134 includes a surface temperature sensor 138 operable to sense the temperature of production 128 flowing through the well surface system 124, after it exits the wellbore 120. The surface temperature sensor 138 may include, for example, a wellhead temperature sensor that senses a temperature of production 128 flowing through or otherwise located in the wellhead 130, referred to as "wellhead temperature" (T). In some embodiments, the surface sensing system 134 includes a flow rate sensor 140 operable to sense the flow rate of production 128 flowing through the well surface system 124, after it exits the wellbore 120. The flow rate sensor 140 may include hardware that senses a flow rate of production 128 (Q) passing through the wellhead 130.

Keeping with FIG. 1, when completing a well, one or more well completion operations may be performed prior to delivering the well to the party responsible for production or injection. Well completion operations may include casing operations, cementing operations, perforating the well, gravel packing, directional drilling, hydraulic stimulation of a reservoir region, and/or installing a production tree or wellhead assembly at the wellbore 120. Likewise, well operations may include open-hole completions or cased-hole completions. For example, an open-hole completion may refer to a well that is drilled to the top of the hydrocarbon reservoir. Thus, the well may be cased at the top of the reservoir and left open at the bottom of a wellbore. In contrast, cased-hole completions may include running casing into a reservoir region.

In one well completion example, the sides of the wellbore 120 may require support, and thus casing may be inserted into the wellbore 120 to provide such support. After a well has been drilled, casing may ensure that the wellbore 120 does not close in upon itself, while also protecting the wellstream from outside contaminants, like water or sand. Likewise, if the formation is firm, casing may include a solid string of steel pipe that is run in the well and will remain that way during the life of the well. In some embodiments, the casing includes a wire screen liner that blocks loose sand from entering the wellbore 120.

In another well operation example, a space between the casing and the untreated sides of the wellbore 120 may be cemented to hold a casing in place. This well operation may include pumping cement slurry into the wellbore 120 to displace existing drilling fluid and fill in this space between the casing and the untreated sides of the wellbore 120. Cement slurry may include a mixture of various additives and cement. After the cement slurry is left to harden, cement may seal the wellbore 120 from non-hydrocarbons that attempt to enter the wellstream. In some embodiments, the cement slurry is forced through a lower end of the casing and into an annulus between the casing and a wall of the bored hole of the wellbore 120. More specifically, a cementing plug may be used for pushing the cement slurry from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

Keeping with well operations, some embodiments include perforation operations. More specifically, a perforation operation may include perforating casing and cement at different locations in the wellbore 120 to enable hydrocarbons to enter a wellstream from the resulting holes. For example, some perforation operations include using a perforation gun at one or more reservoir levels to produce holed sections through the casing, cement, and sides of the wellbore 120. Hydrocarbons may then enter the wellstream through these holed sections. In some embodiments, perforation operations are performed using discharging jets or shaped explosive charges to penetrate the casing around the wellbore 120.

In another well completion, a filtration system may be installed in the wellbore 120 in order to prevent sand and other debris from entering the wellstream. For example, a gravel packing operation may be performed using a gravel-packing slurry of appropriately sized pieces of coarse sand or gravel. As such, the gravel-packing slurry may be pumped into the wellbore 120 between a casing's slotted liner and the sides of the wellbore 120. The slotted liner and the gravel pack may filter sand and other debris that might have otherwise entered the wellstream with hydrocarbons. In another well completion, a wellhead assembly may be installed on the wellhead of the wellbore 120. A wellhead assembly may include a production tree (also called a Christmas tree) that includes valves, gauges, and other components to provide surface control of subsurface conditions of a well.

In some embodiments, a wellbore 120 includes one or more casing centralizers. For example, a casing centralizer may be a mechanical device that secures casing at various locations in a wellbore to prevent casing from contacting the walls of the wellbore. Thus, casing centralization may produce a continuous annular clearance around casing such that cement may be used to completely seal the casing to walls of the wellbore. Without casing centralization, a cementing operation may experience mud channeling and poor zonal isolation. Examples of casing centralizers may include bow-spring centralizers, rigid centralizers, semi-rigid centralizers, and mold-on centralizers. In particular, bow springs may be slightly larger than a particular wellbore in order to provide complete centralization in vertical or slightly deviated wells. On the other hand, rigid centralizers may be manufactured from solid steel bar or cast iron with a fixed blade height in order to fit a specific casing or hole size. Rigid centralizers may perform well even in deviated wellbores regardless of any particular side forces. Semi-rigid centralizers may be made of double crested bows and operate as a hybrid centralizer that includes features of both bow-spring and rigid centralizers. The spring characteristic of the bow-spring centralizers may allow the semi-rigid centralizers to compress in order to be disposed in tight spots in a wellbore. Mold-on centralizers may have blades made of carbon fiber ceramic material that can be applied directly to a casing surface.

In some embodiments, well intervention operations may also be performed at a well site. For example, well intervention operations may include various operations carried out by one or more service entities for an oil or gas well during its productive life (e.g., hydraulic fracturing operations, coiled tubing, flow back, separator, pumping, wellhead and production tree maintenance, slickline, braided line, coiled tubing, snubbing, workover, subsea well intervention, etc.). For example, well intervention activities may be similar to well completion operations, well delivery operations, and/or drilling operations in order to modify the state of a well or well geometry. In some embodiments, well intervention operations are used to provide well diagnostics, and/or manage the production of the well. With respect to service entities, a service entity may be a company or other actor that performs one or more types of oil field services, such as well operations, at a well site. For example, one or more service entities may be responsible for performing a cementing operation in the wellbore 120 prior to delivering the well to a producing entity.

Turning to the reservoir simulator 160, a reservoir simulator 160 may include hardware and/or software with functionality for performing a well simulation (e.g., well simulations of the wellbore of one or more wells) such as storing and analyzing well logs, production data, sensor data (e.g., from a wellhead, downhole sensor devices, or flow control devices), and/or other types of data to generate and/or update one or more geological models of one or more reservoir regions. Geological models may include geochemical or geomechanical models that describe structural relationships within a particular geological region. Likewise, a reservoir simulator 160 may also determine changes in reservoir pressure and other reservoir properties for a geological region of interest, e.g., in order to evaluate the health of a particular reservoir during the lifetime of one or more producing wells.

While the reservoir simulator 160 is shown at a well site, in some embodiments, the reservoir simulator 160 or other components in FIG. 1 may be remote from a well site. In some embodiments, the reservoir simulator 160 is implemented as part of a software platform for the well control system 126. The software platform may obtain data acquired by a control system as inputs, which may include multiple data types from multiple sources. The software platform may aggregate the data from these systems in real time for rapid analysis. In some embodiments, the well control system 126 and the reservoir simulator 160, and/or a user device coupled to one of these systems may include a computer system that is similar to the computer system described below with regard to FIG. 7 and the accompanying description.

In some embodiments, the reservoir simulator 160 may include software configured with machine learning capabilities and artificial intelligence (AI) that learn from trends of the one or more parameters tracked by the well control system 126.

In one or more embodiments, the AI and machine learning (ML) capabilities employed by the reservoir simulator may include any suitable algorithms and processes for predicting well behavior using historical data as input. For example, the machine-learning models (ML models) or algorithms may include supervised algorithms, unsupervised algorithms, deep learning algorithms that use artificial neural networks (ANN), etc. More specifically, supervised ML models include classification, regression models, etc. Unsupervised ML models include, for example, clustering models. Deep-learning algorithms are a part of ML algorithms based on artificial neural networks with representation learning. For example, the deep-learning algorithm may run data through multiple layers of neural network algorithms, each of which passes a simplified representation of the data to the next layer. With respect to neural networks, for example, a neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights and biases for adjusting the data inputs. These network weights and biases may amplify or reduce the value of a particular data input, thereby assigning an amount of significance to various data inputs for a task being modeled. Through machine learning, a neural network may determine which data inputs should receive greater priority in determining one or more specified outputs of the neural network. Likewise, these weighted data inputs may be summed such that this sum is communicated through an activation function of a neuron to other hidden layers within the neural network. As such, the activation function may determine whether, and to what extent, an output of a neuron progresses to other neurons where the output may be weighted again for use as an input to the next hidden layer.

In some embodiments, a machine-learning model may include an encoder model that transforms input data to a latent representation vector. The machine-learning model may further amalgamate the latent representation vector with a vector representation of a particular parameterization to produced combined data, e.g., using in a latent space domain. Likewise, the machine-learning model may also include a decoder model that transforms the combined vector into the corresponding output data according to the parameterization.

In some embodiments, the machine-learning model is a variational autoencoder. For example, variational autoencoders may compress input information into a constrained multivariate latent distribution through encoding in order to reconstruct the information during a decoding process. Thus, variational autoencoders may be used in unsupervised, semi-supervised, and/or supervised machine-learning algorithms. More specifically, variational autoencoders may perform a dimensionality reduction that reduces the number of features within an input dataset (such as an input gather). This dimensionality reduction may be performed by selection (e.g., only some existing features are preserved) or by extraction (e.g., a reduced number of new features are produced from preexisting features). Thus, an encoder process may compress the input data (i.e., from an initial space to an encoded space or latent space), while a decoder process may decompress the compressed data. This compression may be lossy, such that a portion of the original information in the input dataset cannot be recovered during the decoding process.

In some embodiments, various types of machine learning algorithms may be used to train the model, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function.") The error function may be based on various criteria, such as mean squared error function, a similarity function, etc., where the error function may be used as a feedback mechanism for tuning weights in the electronic model.

In some embodiments, a machine-learning model is trained using multiple epochs. For example, an epoch may be an iteration of a model through a portion or all of a training dataset. For example, the training data may include labeled images of interactions that are classified with one or more predetermined interactions. As such, a single machine-learning epoch may correspond to a specific batch of training data, where the training data is divided into multiple batches for multiple epochs. Thus, a machine-learning model may be trained iteratively using epochs until the model achieves a predetermined criterion, such as predetermined level of prediction accuracy or training over a specific number of machine-learning epochs or iterations. Thus, better training of a model may lead to better predictions by a trained model.

In accordance with one or more embodiments disclosed methods and systems may obtain training data that includes a plurality of labeled interactions of historical interactions. A respective labeled interaction among the plurality of labeled interactions may correspond to a predetermined interaction. The coreflooding simulation model may then be trained using the training data.

Figure 2:
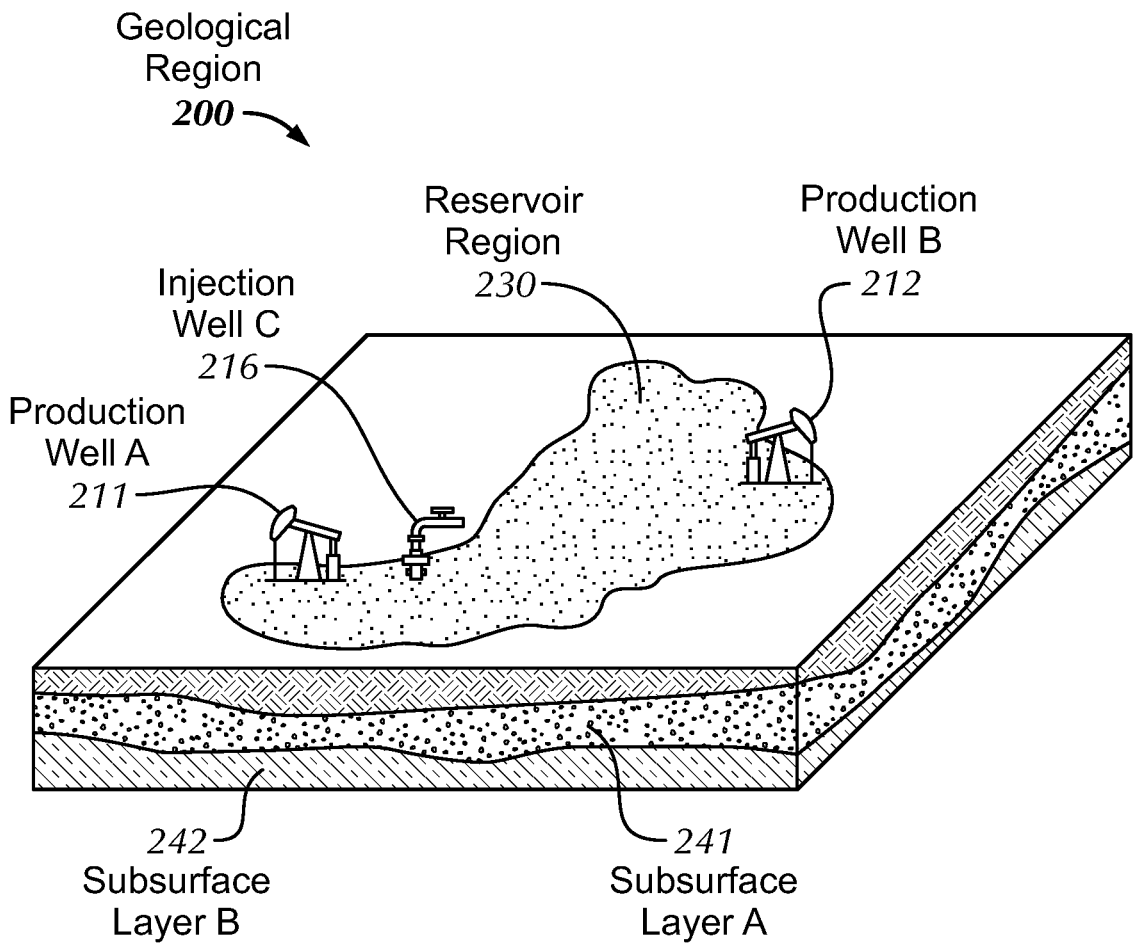

Turning to FIG. 2, FIG. 2 shows a schematic diagram in accordance with one or more embodiments. As illustrated in FIG. 2, FIG. 2 shows a geological region 200 that may include one or more reservoir regions (e.g., a reservoir region 230) with various production wells (e.g., a production well A 211, a production well B 212). For example, a production well may be similar to the well system 106 described above in FIG. 1 and the accompanying description. Likewise, a reservoir region may also include one or more injection wells (e.g., injection well C 216) that include functionality for enhancing production by one or more neighboring production wells. As shown in FIG. 2, wells may be disposed in the reservoir region 230 above various subsurface layers (e.g., subsurface layer A 241, subsurface layer B 242), which may include hydrocarbon deposits. In particular, production data and/or injection data may exist for a particular well, where production data may include data that describes production or production operations at a well, such as wellhead data 150 described in FIG. 1 and the accompanying description.

Figure 3:
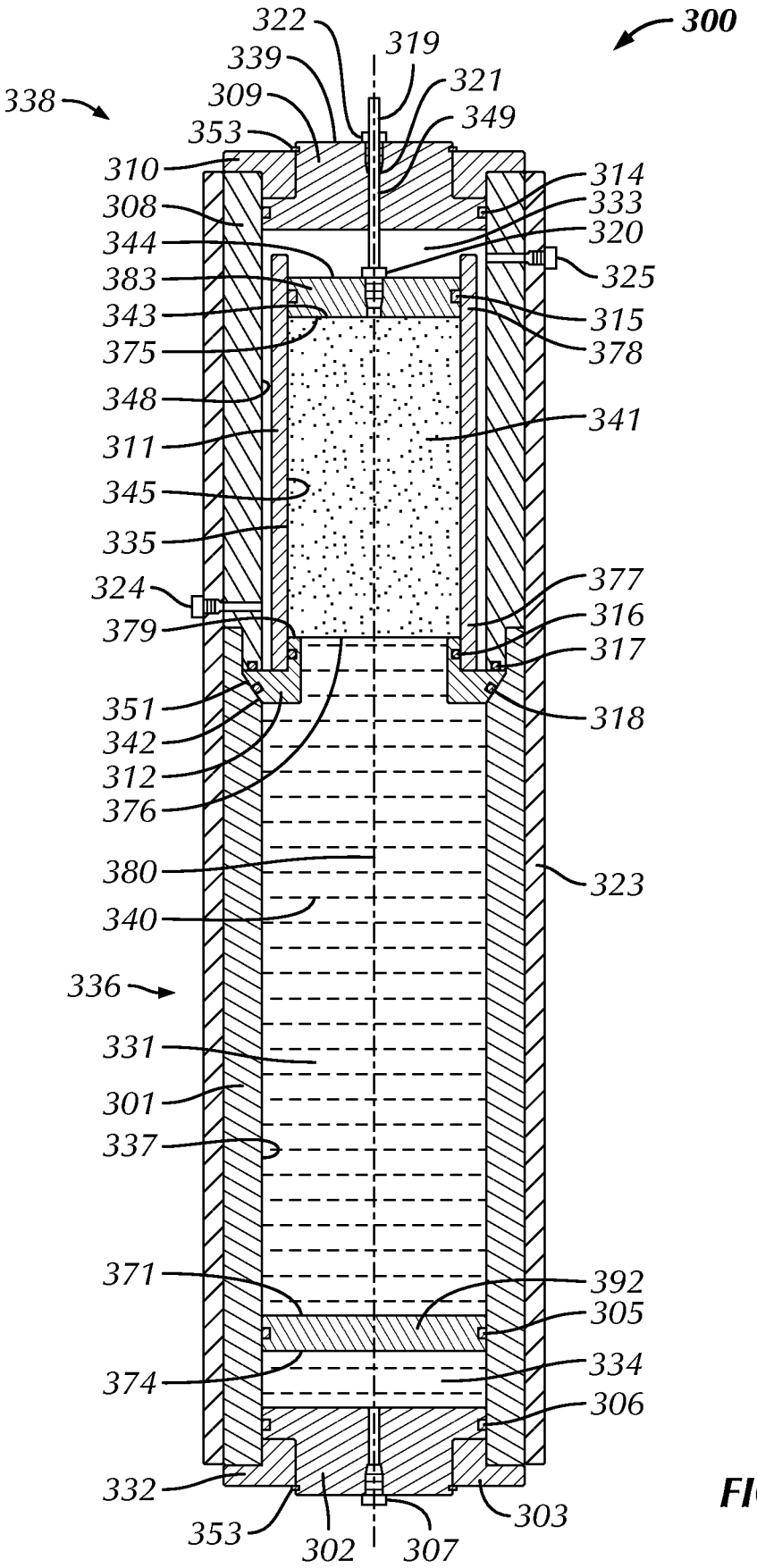

FIG. 3 illustrates the configuration of a compact core flood test apparatus (e.g., a test apparatus 300) in accordance with one or more embodiments. FIG. 3 shows the hydraulic part of the test apparatus 300 comprises a fluid cell 336 with two portions separated by a piston 392. The piston 392 seals against a cell inner wall 337 using a piston o-ring 305. In this manner the piston 392 is configured to sealingly divide the fluid cell 336 into the two portions. A first portion of the fluid cell 336 has a treatment fluid cell (e.g., a cell 331) for containing a core flood fluid (e.g., a test fluid 340) such as candidate treatment fluid for an operation such as an injection operation. A second portion of the fluid cell 336 has a hydraulic fluid chamber (e.g., a hydraulic chamber 334).

The cell 331 of fluid cell 336 is defined in part by the cell inner wall 337 of a cell body 301. The top part of the test apparatus 300 comprises a core sample holder (e.g., a holder 338). The cell body 301 is a cylindrical tube with two opening ends. The top opening is connected to the core sample holder, and the bottom opening is closed by a first end cap 332 comprising a first cap body (e.g., a cap body 302) and a cap retainer nut 303. The first end cap set (e.g., the first end cap 332) may be held together by a snap ring (e.g., a snap ring 353.) When threading the cap retainer nut 303 onto the cell body, this connection allows the cap body 302 to move along the axial direction only, i.e., cap body 302 may move substantially parallel with a body axis (e.g., an axis 380).

The piston 392 located inside of the cell body is used to separate a pump-injected fluid from the testing fluid (e.g., a candidate injection fluid) that will flow through the core sample. The piston 392 has a lower end (e.g., a piston hydraulic side 374) that is exposed to a pump-injected fluid, such as a hydraulic fluid. The pump-injected fluid is provided by a pump fluid source. A hydraulic pressure pump pressurizes the hydraulic fluid from the hydraulic source to form the pump-injected fluid (e.g., a pressurized fluid). The pressurized fluid is pumped into the hydraulic chamber 334 using the hydraulic fitting 307. The piston 392 has an upper end (e.g., a piston treatment fluid side 371) that is exposed to the treatment fluid contained in cell 331. Piston 392 pressurizes the treatment fluid in cell 331 to convey the treatment fluid through a core sample (e.g., a core sample 341).

A piston sealing element (e.g., the piston o-ring 305) on the piston 392 and a first cap sealing element (e.g., a first cap o-ring 306) on the cap body 302 are used for sealing. The piston o-ring 305 forms a slidable seal between the piston 392 and the cell body 301. The first cap o-ring 306 forms a seal between the first end cap body (e.g., the cap body 302)

and the cell body 301. A core piston (e.g., a movable plug 383) is configured to have a sliding fit inside the core sleeve (e.g., a core sleeve 311). A movable plug sealing element (e.g., a core piston o-ring 315) forms a slidable seal between the movable plug 383 and a sleeve inner surface 345 of the core sleeve 311. A tube fitting (e.g., a hydraulic fitting 307) can be used to connect a tubing (not shown) for pumping the pump-injected fluid, (e.g., the hydraulic substance) into the hydraulic chamber 334. In accordance with one or more embodiments the piston 392 may be a plunger and the sealing element, e.g., the piston o-ring 305, may be installed in a sleeve o-ring groove of the cell body 301.

FIG. 3 shows the components of the core sample holder. A core holder body 308 of holder 338 is threaded onto the fluid cell body (e.g., the cell body 301) after the core sample is loaded. The cylindrical tube-shaped, core holder body 308 has a chamber inner wall 348 to form a cylindrical wall of the confining chamber. The top opening is closed by a second end cap 339 comprising a second cap body 309 and a cap retainer 310. The second end cap set can be similarly held together by a snap ring (e.g., the snap ring 353). Cap retainer 310 may be threaded, using a cap thread element, into a mating thread at the top end of the core holder body 308. The second end cap 339 may connect to the core holder body 308 using the cap thread element. The second end cap 339 may include a sealing element (e.g., a second cap o-ring 314) that forms a seal between the core holder body 308 and the second cap body 309.

The core sample 341 has a core outer surface 335, a core front surface (e.g., a core outlet end face 375), and a core back surface (e.g., a core inlet end face 376). The core sample 341 is loaded into the core sleeve 311, with a fixed plug 312 and the movable plug 383 inserted from the two ends of the sleeve. The fixed plug 312 is coupled to a sleeve first end 377 and the movable plug 383 is inserted into a sleeve second end 378. The fixed plug 312 has an end plug sample surface 379 that is arranged to form a core back surface-surface contact with the core back surface (e.g., the core inlet end face 376). The movable plug 383 has a core piston surface (e.g., an end plug surface 343) that is arranged to form a core front surface-surface contact with the core front surface (e.g., the core outlet end face 375). Thus, cell 331 of fluid cell 336 is enclosed by the cell inner wall 337, the fixed plug 312 of the holder 338, the core inlet end face 376, and the piston treatment fluid side 371. Likewise, the hydraulic chamber 334 of fluid cell 336 is enclosed by the cell inner wall 337, the cap body 302 of the first end cap 332, and the piston hydraulic side 374.

In accordance with one or more embodiments the core sleeve 311 is conformable to the shape of the core sample 341. For example, the conformable sleeve (e.g., the core sleeve 311) may comprise a flexible material such as rubber. The core sleeve 311 has a sleeve inner surface 345. The conformable sleeve may form a core outer surface-surface contact between the core outer surface 335 and the sleeve inner surface 345. Thus, this flexible type of sleeve (e.g., the core sleeve 311) can accommodate varied outside diameters and various outside diameter surface finishes of core samples.

As coupled to the cell body, the fixed plug 312 will be positioned near the top of the fluid cell body (e.g., the cell body 301). A bevel 342 disposed on the cell body 301 cooperates with a taper 351 on the fixed plug 312 to position fixed plug 312 with respect to cell body 301 along axis 380. Various o-rings are used for sealing. A protrusion sealing element (e.g., a protrusion o-ring 316) forms a seal between an end plug protrusion outer surface and the sleeve inner surface 345. A lip sealing element (e.g., a lip o-ring 317) forms a seal between a lip of the core holder body and an end plug seal surface. A taper sealing element (e.g., a taper o-ring 318) forms a seal between the taper 351 and the bevel 342.

A translatable tube is translatable through the second end cap 339 while maintaining a seal between the tube OD and the second end cap 339. In this sense the translatable tube may be known as a movable tube (e.g., a tubing 319) with a sealing fit between the translatable tube and the second end cap. The tubing 319 is connected to the core movable plug (e.g., movable plug 383) by a movable tubing fitting 320. The commonly used tubing fittings are ferrules and glands or nuts. The movable plug 383 may translate along, or parallel to, the axis 380, i.e., the movable plug 383 may move with respect to the core sleeve 311 along the axis 380. The movable feature of the movable plug 383 enables a longitudinal flexibility along axis 380 of the holder 338 for various sizes of core samples. Thus, this flexible type of end plug (e.g., the movable plug 383) can accommodate varied lengths of core samples.

In accordance with one or more embodiments, a small hole (e.g., a movable tubing hole 349) is disposed on the end cap body (e.g., the second cap body 309). The movable tube may slide in and out of the second cap body 309 while simultaneously sealing using a seal between the tube and the cap. The small hole allows the tubing 319 to go through the hole and to allow axial movement of the tubing. The diameter of the small hole on the cap body is slightly larger than the outside diameter of the tubing 319 to enable the tubing 319 to move along the axis 380 with respect to the end cap body. The small gap between the hole and tubing 319 is sealed by a cap-to-tube sealing element such as an o-ring to form a linear motion seal between the movable tubing hole 349 and the tubing 319. For example, the small gap may be sealed by compressing the cap-to-tube scaling element (e.g., a cap tube o-ring 321) using a gland nut 322.

After the core holder part (e.g., the holder 338) is connected with the fluid cell (e.g., the fluid cell 336) by threading the core holder body (e.g., core holder body 308) onto the cell body (e.g., cell body 301), a heating jacket (e.g., jacket 323) may be put on the outside of the whole assembly for tests at high temperature, e.g., tests at temperatures higher than ambient temperature. Alternatively, a cooling jacket may be used for performing tests at temperatures lower than ambient temperature. Ports (e.g., a first confining port 324 and a second confining port 325) are used for applying a confining pressure to the core sample by pressurizing a confining chamber 333. The confining pressure may be developed by pressurizing a confining substance. An example confining substance is a confining fluid such as a hydraulic oil or water from a confining substance source using a confining pressure pump. The confining chamber is configured for confining pressure to be applied to the exterior of the core sleeve and to a movable plug front 344 surface. Confining pressure applied to the movable plug front 344 surface may move the piston along axis 380 toward the core sample 341. And example of a confining pressure is a high pressure such as a pressure higher than ambient pressure. An example of a high pressure is a pressure equivalent to a downhole environment or reservoir pressure.

Figure 4:
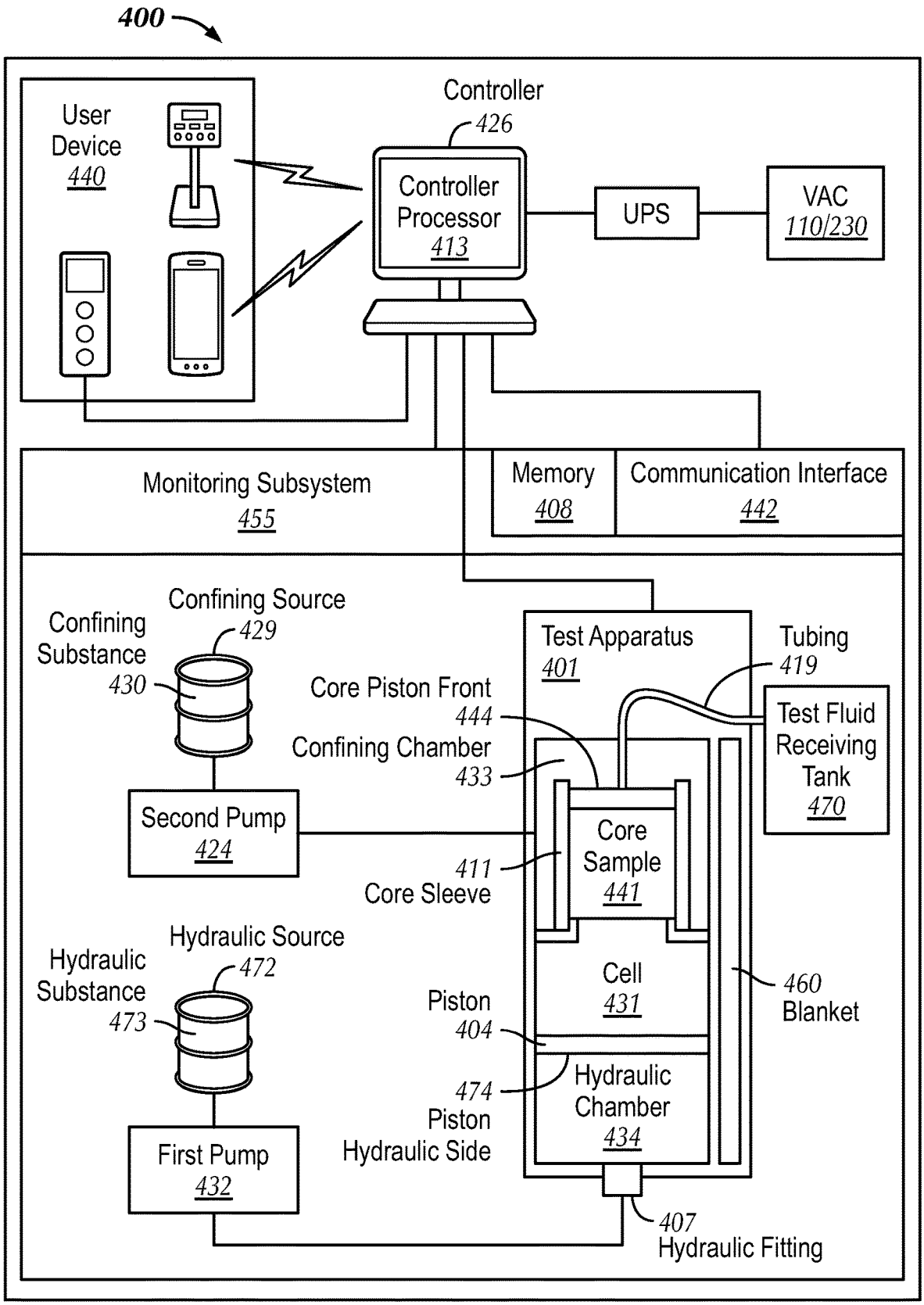

FIG. 4 shows a core flood test system. In accordance with one or more embodiments the test apparatus may be used in a core flood test system (e.g., a system 400). The core flood test system may include the testing apparatus (e.g., an apparatus 401) and a core control system (e.g., a controller 426) attached to the apparatus. The core control system may be electrically attached for power, signal-attached for control tasks such as commands, sensor monitoring, and data exchange, hydraulically attached for providing pressure and flow, and structurally attached for structural support. The core control system may include a computer processor (e.g., a controller processor 413) and a user device (e.g., a user device 440) with a graphical user interface. The user device may be used for presenting first acquired coreflooding simulation data regarding the one or more simulation parameters. For example, the user device may display the test fluid chemical formulation, the test pressure, the test temperature, etc. The user device may be configured to receive user input from a user. The user input may be a user selection of one or more replacement simulation parameters. The user may provide the user input in response to the presenting that the interaction of the first coreflooding simulation fails to satisfy the predetermined interaction. The user input may be transmitted from the user device to the control system.

FIG. 4 shows that the core flood test system may include a monitoring subsystem 455. The monitoring subsystem may be connected to none, some, or all of the components within the core flood test system. The monitoring subsystem may be configured to detect, measure, monitor, record, and report test parameters such as pressure, temperature, volume, flowrate, chemical composition, mass, time durations, time of day, and date. For example, the monitoring subsystem may have pressure sensors configured to detect pressure within the confining chamber 433 and the hydraulic chamber 434 as well as the pump output pressures from the first pump 432 and the second pump 424. The monitoring subsystem may detect temperature within, on, or around the apparatus 401.

The monitoring subsystem 455 may have a communication interface 442. The communication interface may be coupled to the monitoring subsystem. The communication interface may also be coupled to a processor such as the controller processor 413 and to a memory 408. The communication interface is configured to transmit the coreflooding simulation data to a control system such as the controller 426. The memory is configured to store the coreflooding simulation data. The memory may also be coupled to the processor. The memory may have instructions for performing a method such as obtaining a command to generate the coreflooding simulation data, generating the coreflooding simulation data, and transmitting the coreflooding simulation data using the communication interface.

The test fluid flowing out of tubing 419 is received by a test fluid receiving tank 470. A first confining port (e.g., the first confining port 324, FIG. 3) and a second confining port (e.g., the second confining port 325, FIG. 3) are used for applying a confining pressure to a core sample (e.g., a core sample 441) by pressurizing a confining chamber 433. The confining pressure may be developed by pressurizing a confining substance 430. An example confining substance is a confining fluid such as a hydraulic oil or water from a confining substance source (e.g., a confining substance source 429) using a confining pressure pump (e.g., a second pump 424). The second pump 424 may be part of a second pump system that includes various pump accessories such as a power switch, pressure regulator, pressure relief valve, pressure bypass valve, recirculation circuit, monitoring features (pressure gauge, fluid level gauge, etc.), and other controls. The confining chamber is configured for confining pressure to be applied to the exterior of the core sleeve (e.g., a core sleeve 411) and to a movable plug front (e.g., a movable plug front 444) surface.

The testing fluids are pressurized using the hydraulic pump by pressurizing a pump-injected fluid (e.g., a hydraulic fluid 473) on a piston hydraulic side (e.g., piston hydraulic side 474). The pump-injected fluid is provided by a hydraulic fluid source (e.g., hydraulic source 472). The hydraulic fluid is introduced into a hydraulic chamber 434 from the hydraulic source. A hydraulic pump (e.g., a first pump 432) pressurizes the hydraulic fluid to form the pressurized fluid. The first pump 432 may be part of a first pump system that includes various pump accessories such as power switch, pressure regulator, pressure relief valve, pressure bypass valve, recirculation circuit, monitoring features (pressure gauge, fluid level gauge, etc.), and other controls. The pressure is conveyed into the hydraulic chamber 434 using a hydraulic fitting 407 such that the hydraulic chamber is under pressure from the pressurized fluid. In this manner the piston 404 pressurizes the test fluid in cell 431 against the core inlet end face. The piston displaces test fluid to deliver the test fluid into and through the core sample. The test fluid flows through the core sample, out of the sample at the core outlet end face, out of the apparatus out through tubing 419. The test fluid flowing out of tubing 419 is received by the test fluid receiving tank 470.

The test apparatus may include a heating jacket or heating blanket (e.g., a jacket 460) for temperature control with the heating jacket covering, for example, the core holder, the confining chamber 433, the hydraulic chamber 434, and the injection fluid. In accordance with one or more embodiments the jacket 460 may comprise a cooling jacket or cooling sleeve used for reducing the temperature of the apparatus to a temperature below room temperature. The jacket 460 may make contact with the components of the system or the jacket may be in proximity to the components. The monitoring subsystem may detect temperature from the jacket, between the jacket and the components, or within the components. The monitoring subsystem may detect a current draw (e.g., an amperage) of electricity being drawn by the jacket. The monitoring subsystem may detect a flowrate and temperature of a heating medium or cooling medium being circulated through the jacket.

Figure 5:
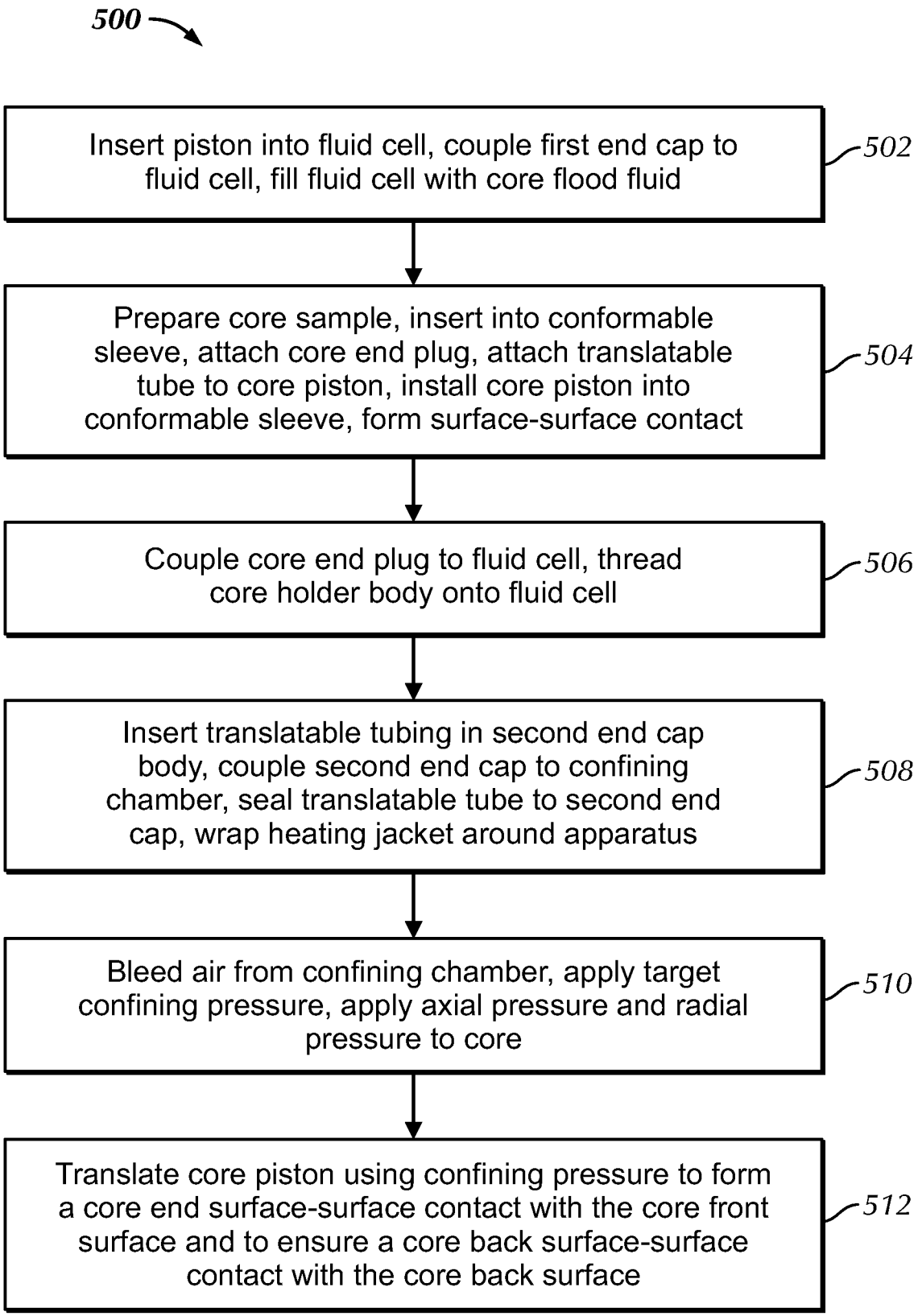
FIGS. 5 and 6 show flowcharts in accordance with one or more embodiments.

Turning to FIG. 5, FIG. 5 shows a general sequence for assembling and sample loading. A preparation method 500 includes the following steps. The steps are performed by the elements in FIG. 3. A fluid cell step 502 includes the following actions. First, the piston 392 is inserted into the cell body 301 of the cell 331. Then the first end cap 332 is coupled to cell body 301 and the injection fluid is prepared and the cell body 301 is filled in the cell 331 of the fluid cell 336.

In accordance with one or more embodiments the injection fluid is a candidate injection fluid, i.e., a test fluid or core flood fluid. The candidate injection fluid may be a chemical blend or chemical formulation that the investigators have prepared and have nominated as a candidate to be tested with the core sample acquired from the reservoir of interest. The investigators may have nominated the test fluid based on historical data of interactions between historical fluids and historical reservoirs, i.e., injection fluids that have been used in the past with formations similar to the formation of interest.

FIG. 5 continues the preparation method 500 with a step (e.g., a core step 504) to prepare the core sample and to insert the core sample into the conformable sleeve (e.g., the core sleeve 311). The method continues with installation of the protrusion o-ring 316 and the taper o-ring 318 onto the fixed plug 312. The method includes inserting the core end plug into a sleeve end (e.g., the sleeve first end 377) of the core sleeve 311. The next step is to use the movable tubing fitting 320 to connect tubing 319 to the movable plug 383 and to install a core piston sealing element such as an o-ring (e.g., a core piston o-ring 315) into a piston o-ring groove of the movable plug 383. The next step is to insert this end plug set (e.g., the movable plug and o-ring) into the other end (e.g., the sleeve second end 378) of the core sleeve 311. The method continues with installation of both of the end plugs (e.g., the fixed plug 312 and the movable plug 383) such that they make contact with the core sample. In accordance with one or more embodiments, the movable plug 383 may be a plunger and the sealing element, e.g., the core piston o-ring 315, may be installed in a sleeve o-ring groove of the core sleeve 311.

Next is a cell joining step 506. The assembly of the core, the sleeve, and the core end plugs is then disposed on the top of the fluid cell (e.g., the cell body 301) with the fixed plug 312 positioned on the top rim (e.g., on the bevel 342) of the cell body 301. Then, the lip o-ring 317 is installed onto the bottom end of the core holder body 308, and the core holder body 308 is threaded onto the cell body 301 to push the fixed plug 312 along the axis 380 (e.g., downward) to contact the cell body rim at the bevel 342 and to compress the taper o-ring 318 between the bevel 342 and the taper 351.

Following these actions is a confining step 508 that includes the following steps. The tubing 319 is inserted through the small hole on the cap body (e.g., the second end cap body 9), then the second end cap 339 is put onto the top end of the core holder body 308 to close the confining chamber. The cap body will be pushed downward along axis 380 when threading the cap retainer 310 onto the core holder body 308. The second cap o-ring 314 on the cap body seals the gap, thereby forming a seal, between the cap body and the core holder body 308. After closing this end cap, the cap tube o-ring 321 is put over the tubing 319 and the gland nut 322 is used to seal the gap outside of tubing 319. A heating jacket is put on the outside of the whole assembly (the test apparatus 300) for high-temperature tests.

A general sequence for readying the test apparatus 300 for performing a test are as follows (e.g., a confine core step 510). The air from the confining chamber is bled out. The confining substance is pumped from the confining substance source through the first confining port 324 to fill the void space (e.g., the confining chamber 333) inside of the core holder body, and the air can be pushed out (i.e., the air can be bled out) through the second confining port 325. After fully filling the void space, the second confining port 325 is closed and a target confining pressure is applied to the core samples. Hydrostatic confining pressure in the confining chamber applies the axial pressure and the radial pressure to the core thereby conforming, using the confining pressure, the conformable sleeve around the core sample to form the core outer surface-surface contact between the sleeve inner surface and the core outer surface.

A translate tube step 512 follows. The translatable type of end cap (e.g., a core end plug or core piston, i.e., the movable plug 383) translated by the confining pressure allows the end plug surface 343 to form a core end surface-surface contact with the core outlet end face 375. As the movable plug 383 translates along axis 380, the tubing 319 moves slightly along axis 380 through cap tube o-ring 321 and gland nut 322. The translating of the movable plug 383 and the tubing 319 forms the core end surface-surface contact with the core outlet end face. The fixed plug 312 is coupled to the sleeve first end 377 of the core sleeve 311. The translating also translates the core sample 341 to contact the end plug sample surface 379 of the core end plug (e.g., the fixed plug 312) to form the core back surface-surface contact with the core back surface (e.g., the core inlet end face 376) of the core sample 341. In this manner, a sample confining pressure is applied onto the core sample in both a radial direction and an axial direction.

Figure 6:
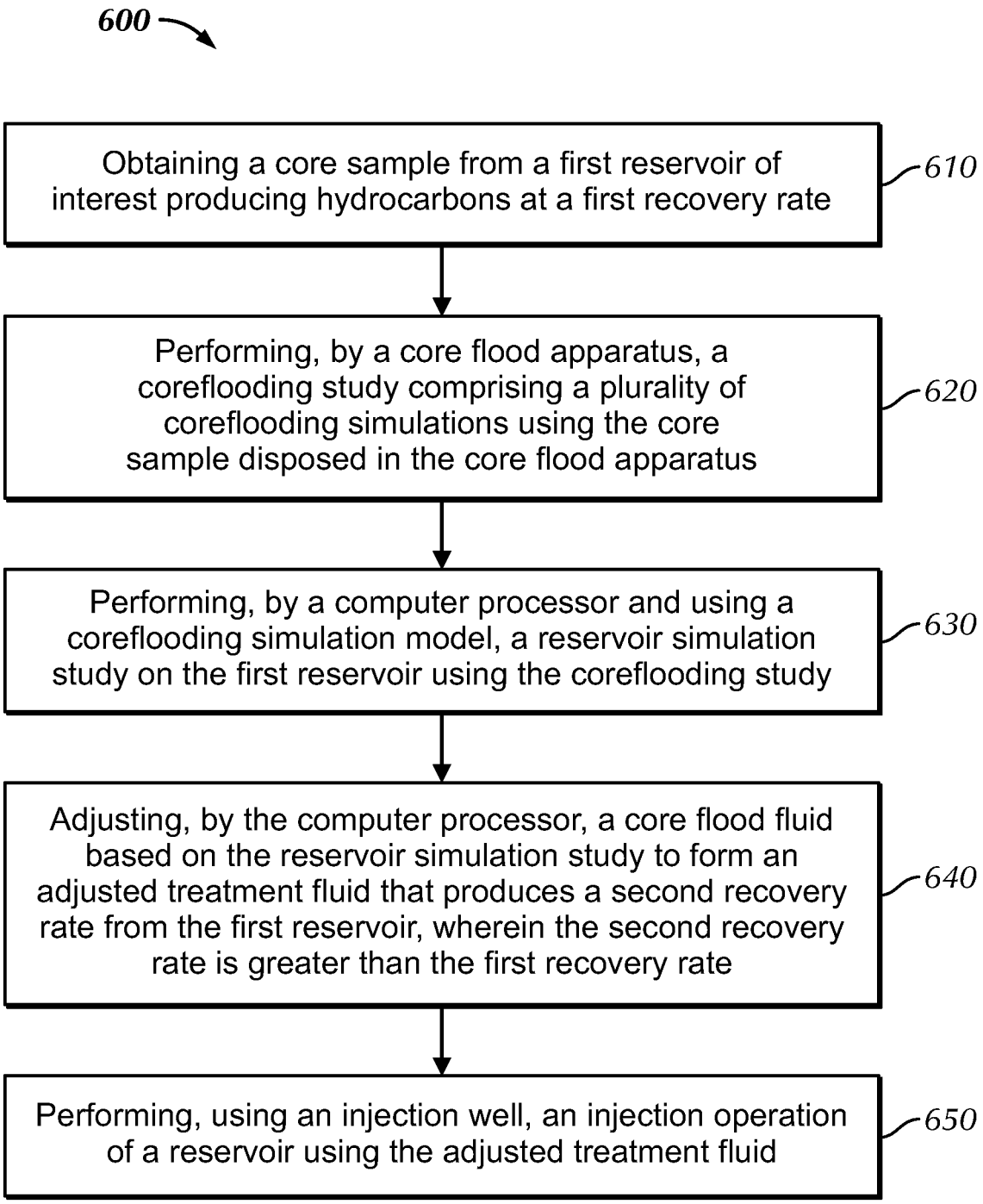

FIG. 6 is a flowchart of an example production method 600 for operating a production well to change the production rate of the production well from a first production rate to a second production rate. The production method 600 includes the following steps.

At step 610, the production method includes acquiring a core sample from a first reservoir of interest; wherein the first reservoir is producing hydrocarbons at a first recovery rate.

At step 620, the production method includes performing, by a core flood apparatus, a coreflooding study comprising a plurality of coreflooding simulations using the core sample disposed in the core flood apparatus. Each coreflooding simulation investigates an interaction between a core flood fluid and a core sample. The interaction may be affected by several test factors such as environmental parameters (e.g., pressure, temperature), core sample parameters (e.g., porosity), and core flood fluid parameters (e.g., chemical formulation or chemical blend, injection pressure.) The study detects the interaction and compares the interaction with a desired outcome, e.g., a predetermined criterion of a set of predetermined criteria. The desired outcome may be, for example, an interaction indicative of an improved recovery rate or flowrate. The indication may be that when an adjusted treatment fluid is injected into the reservoir, a second recovery rate results and the second recovery rate is greater than the first recovery rate or flowrate. The comparison result may be that the interaction satisfies the predetermined criteria (or a criterion of the criteria). The result may be that the interaction fails to satisfy the predetermined criterion. The outcome of the comparison may result in an action taken. For example, the control system may automatically determine whether the first coreflooding simulation satisfies a predetermined criterion. If the first coreflooding simulation fails to satisfy the predetermined criterion, then the control system may automatically determine replacement simulation parameters for the coreflooding simulation test.

The method may include obtaining first acquired coreflooding simulation data regarding one or more simulation parameters in real-time during a coreflooding simulation test of the plurality of coreflooding simulations for the core sample. The method may then use a control system to automatically determine a first coreflooding simulation using the first acquired coreflooding simulation data. The determining may be based on the coreflooding simulation model. The first coreflooding simulation may include a real-time simulation of coreflooding the first reservoir at a current set of flooding parameters in the coreflooding simulation test.

The method may then use the control system to automatically determine whether or not the first coreflooding simulation satisfies a predetermined criterion. The control system may determine a second coreflooding simulation based on using the replacement simulation parameters for the coreflooding simulation test. The determining may be based on the coreflooding simulation model. The method may include the control system automatically transmitting to the core flood apparatus a first command to update the coreflooding simulation test to implement the replacement simulation parameters.

At step 630, the production method includes performing, by a control system and using a coreflooding simulation model, a reservoir simulation study on the first reservoir using the coreflooding study. The outcome of the coreflooding simulation model may be a validated and optimized treatment fluid formula in core scale for a reservoir. The coreflooding simulation model results may then be used as a source of input parameters for numerical reservoir simulation studies. The coreflooding simulation model may be an artificial neural network comprising an input layer, a plurality of hidden layers, and an output layer.

The core sample in the core flood apparatus may be in a coreflooding system. The first acquired coreflooding simulation data may include introducing the current set of flooding parameters into the core flood apparatus. The first acquired coreflooding simulation data may be an interaction within the core flood apparatus between the current set of flooding parameters and the core sample, and the method may include detecting the interaction. The predetermined criterion may correspond to a predetermined interaction.

The coreflooding study may correspond to a first set of flooding parameters that has a first core flood fluid tested using the first set of flooding parameters. The replacement simulation parameters may have a second set of flooding parameters that has the adjusted treatment fluid. The second coreflooding simulation may correspond to the adjusted treatment fluid tested using the second set of flooding parameters.

The method may include obtaining historical reservoir data for one or more wells at a predetermined distance from the first reservoir. The coreflooding simulation model may use the historical reservoir data to determine the predetermined criterion. The method may include obtaining training data that has a plurality of labeled interactions of historical interactions. A respective labeled interaction among the plurality of labeled interactions may correspond to the predetermined interaction. The method may include performing a training operation of the coreflooding simulation model using the training data.

The computer processor may determine, based on the coreflooding simulation model, a third coreflooding simulation based on using the replacement simulation parameters for the coreflooding simulation test. The replacement simulation parameters may have a third set of flooding parameters that has a third core flood fluid. The third coreflooding simulation may corresponds to the third core flood fluid tested using the third set of flooding parameters. The control system may automatically transmit to the core flood apparatus a second command to terminate the coreflooding simulation test in response to determining that the third coreflooding simulation fails to satisfy the predetermined criterion.

At step 640, the production method includes automatically adjusting, by the control system, a core flood fluid based on the reservoir simulation study to form an adjusted treatment fluid that produces a second recovery rate from the first reservoir. The second recovery rate may be greater than the first recovery rate. For example, the chemical formula of the candidate injection fluid may be adjusted to form a replacement candidate formulation of a candidate injection fluid. The candidate injection fluid may be tested one or more times. Various other simulation parameters such as the candidate viscosity, concentration, flowrate, and pressure may be adjusted to form replacement simulation parameters. The method may include using the control system, the coreflooding simulation model, and the predetermined interaction to automatically determine the second recovery rate.

At step 650, the production method includes performing, using an injection well, an injection operation of a reservoir using the adjusted treatment fluid. For example, after the results from the numerical reservoir simulation studies are obtained, then the optimized injection strategies may be applied to a chemical flooding operation such as waterflooding, EOR, and formation damage evaluations. The method may include producing the hydrocarbons at the second recovery rate from a production well coupled to the first reservoir. The control system may have further functionality for performing the steps of the method. For example, the control system may perform the coreflooding study using the core flood apparatus with a core sample in the core flood apparatus. The control system may have functionality for performing a reservoir simulation study on the first reservoir using the coreflooding study and a coreflooding simulation model. The control system may have functionality for adjusting a core flood fluid based on the reservoir simulation study to form an adjusted treatment fluid that produces a second recovery rate from the first reservoir. The control system may have functionality for performing an injection operation of a reservoir using an injection well and the adjusted treatment fluid.

Figure 7:
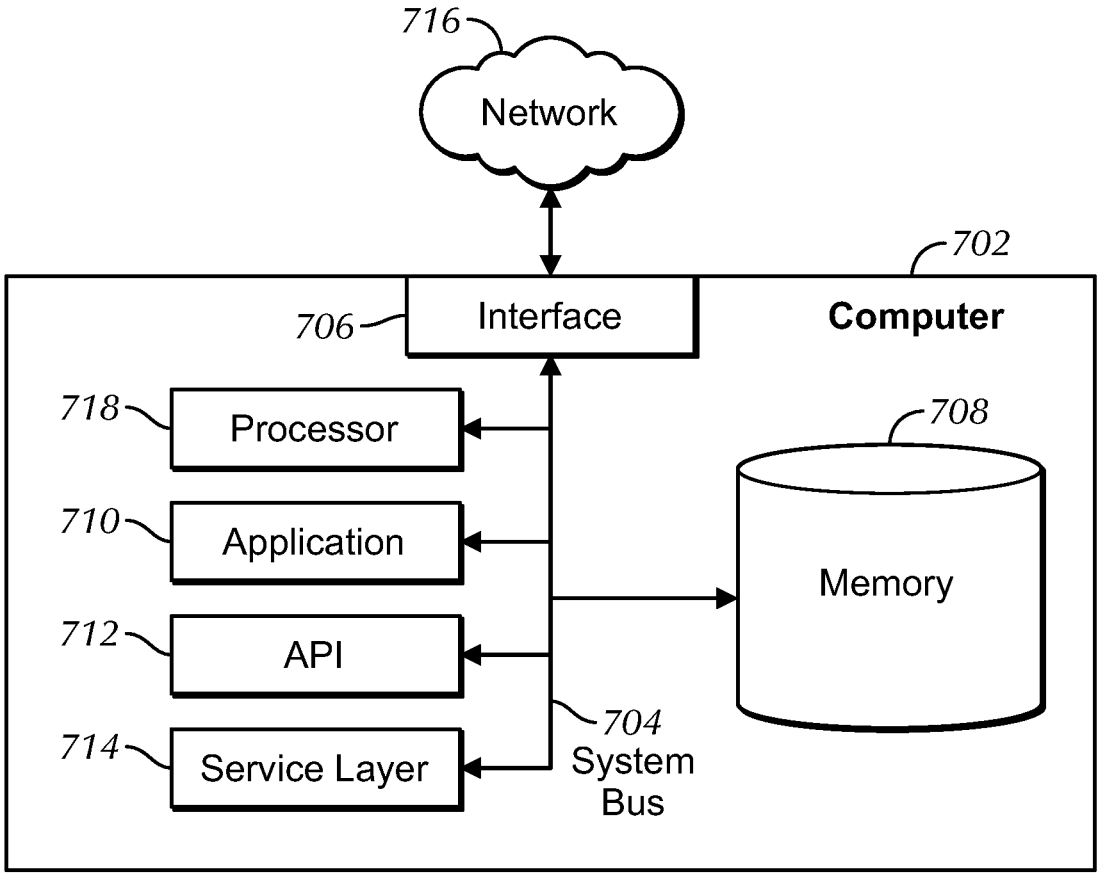
FIG. 7 shows a computer system in accordance with one or more embodiments.

Embodiments may be implemented on a computer system. FIG. 7 is a block diagram of a computer system such as the computer 702 used to provide computational functionalities associated with described algorithms, methods, functions, processes, flows, and procedures as described in the instant disclosure, according to an implementation. The illustrated computer (e.g., computer 702) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 702 may include a computer that includes an input device, such as a keypad, keyboard, touch screen, or other device that can accept user information, and an output device that conveys information associated with the operation of the computer 702, including digital data, visual, or audio information (or a combination of information), or a graphical user interface.

The computer 702 can serve in a role as a client, network component, a server, a database or other persistency, or any other component (or a combination of roles) of a computer system for performing the subject matter described in the instant disclosure. The illustrated computer (computer 702) is communicably coupled with a network 716. In some implementations, one or more components of the computer 702 may be configured to operate within environments, including cloud-computing-based, local, global, or other environment (or a combination of environments).

At a high level, the computer 702 is an electronic computing device operable to receive, transmit, process, store, or manage data and information associated with the described subject matter. According to some implementations, the computer 702 may also include or be communicably coupled with an application server, e-mail server, web server, caching server, streaming data server, business intelligence server, or other server (or a combination of servers).

The computer 702 can receive requests over network 716 from a client application (for example, executing on another computer 702) and responding to the received requests by processing the said requests in an appropriate software application. In addition, requests may also be sent to the computer 702 from internal users (for example, from a command console or by other appropriate access method), external or third-parties, other automated applications, as well as any other appropriate entities, individuals, systems, or computers.

Each of the components of the computer 702 can communicate using a system bus 704. In some implementations, any or all of the components of the computer 702, both hardware or software (or a combination of hardware and software), may interface with each other or the interface 706 (or a combination of both) over the system bus 704 using an application programming interface (an API 712) or a service layer 714 (or a combination of the API 712 and service layer 714. The API 712 may include specifications for routines, data structures, and object classes. The API 712 may be either computer-language independent or dependent and refer to a complete interface, a single function, or even a set of APIs. The service layer 714 provides software services to the computer 702 or other components (whether or not illustrated) that are communicably coupled to the computer 702. The functionality of the computer 702 may be accessible for all service consumers using this service layer. Software services, such as those provided by the service layer 714, provide reusable, defined business functionalities through a defined interface. For example, the interface may be software written in JAVA, C++, or other suitable language providing data in extensible markup language (XML) format or other suitable format. While illustrated as an integrated component of the computer 702, alternative implementations may illustrate the API 712 or the service layer 714 as stand-alone components in relation to other components of the computer 702 or other components (whether or not illustrated) that are communicably coupled to the computer 702. Moreover, any or all parts of the API 712 or the service layer 714 may be implemented as child or sub-modules of another software module, enterprise application, or hardware module without departing from the scope of this disclosure.

The computer 702 includes an interface 706. Although illustrated as a single interface in FIG. 7, two or more of the interfaces may be used according to particular needs, desires, or particular implementations of the computer 702. The interface 706 is used by the computer 702 for communicating with other systems in a distributed environment that are connected to the network 716. Generally, the interface 706 includes logic encoded in software or hardware (or a combination of software and hardware) and operable to communicate with the network 716. More specifically, the interface 706 may include software supporting one or more communication protocols associated with communications such that the network 716 or hardware of the interface is operable to communicate physical signals within and outside of the illustrated computer (computer 702).

The computer 702 includes at least one of a computer processor 718. Although illustrated as a single computer processor in FIG. 7, two or more processors may be used according to particular needs, desires, or particular implementations of the computer 702. Generally, the computer processor 718 executes instructions and manipulates data to perform the operations of the computer 702 and any algorithms, methods, functions, processes, flows, and procedures as described in the instant disclosure.

The computer 702 also includes a memory 708 that holds data for the computer 702 or other components (or a combination of both) that can be connected to the network 716. For example, memory 708 can be a database storing data consistent with this disclosure. Although illustrated as a single memory in FIG. 7, two or more memories may be used according to particular needs, desires, or particular implementations of the computer 702 and the described functionality. While memory 708 is illustrated as an integral component of the computer 702, in alternative implementations, memory 708 can be external to the computer 702.

The application 710 is an algorithmic software engine providing functionality according to particular needs, desires, or particular implementations of the computer 702, particularly with respect to functionality described in this disclosure. For example, application 710 can serve as one or more components, modules, applications, etc. Further, although illustrated as a single one of application 710, the application 710 may be implemented as a multiple quantity of application 710 on the computer 702. In addition, although illustrated as integral to the computer 702, in alternative implementations, the application 710 can be external to the computer 702.

There may be any number of computers such as the computer 702 associated with, or external to, a computer system containing computer 702, each computer 702 communicating over network 716. Further, the term "client," "user," and other appropriate terminology may be used interchangeably as appropriate without departing from the scope of this disclosure. Moreover, this disclosure contemplates that many users may use one of computer 702, or that one user may use multiple computers such as computer 702.

In some embodiments, the computer 702 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method comprising:

acquiring a core sample from a first reservoir of interest; wherein the first reservoir is producing hydrocarbons at a first recovery rate;

performing, by a core flood apparatus, a coreflooding study comprising a plurality of coreflooding simulations using the core sample disposed in the core flood apparatus;

performing, by a computer processor and using a coreflooding simulation model, a reservoir simulation study on the first reservoir using the coreflooding study;

adjusting, by the computer processor, a core flood fluid based on the reservoir simulation study to form an adjusted treatment fluid that produces a second recovery rate from the first reservoir;

wherein the second recovery rate is greater than the first recovery rate; and performing, using an injection well, an injection operation of a reservoir using the adjusted treatment fluid.

2. The method of claim 1, wherein the core flood apparatus comprises:

a confining chamber defined by a chamber inner wall of a core holder body, a conformable sleeve, a core end plug sealingly coupled to the core holder body and to the conformable sleeve, and a second end cap sealingly coupled to the core holder body;

wherein the core end plug is configured to couple to a sleeve first end of the conformable sleeve, wherein the conformable sleeve is configured to hold the core sample such that a core outer surface-surface contact is formed with a sleeve inner surface and a core outer surface; and wherein the conformable sleeve comprises a core piston configured for a sliding fit within the conformable sleeve, wherein the core piston is inserted into the conformable sleeve from a sleeve second end and configured to form a core end surface-surface contact with a core piston surface;

a fluid cell defined by a cell inner wall of a cell body and a first end cap configured to sealingly couple to the cell body;

wherein the fluid cell is configured to sealingly couple to the confining chamber;

a piston translatably disposed in the fluid cell and configured to sealingly divide the fluid cell into a treatment fluid cell and a hydraulic chamber;

a monitoring subsystem coupled to the confining chamber, the hydraulic chamber, and the treatment fluid cell;

wherein the monitoring subsystem is configured for recording coreflooding simulation data;

a communication interface coupled to the monitoring subsystem;

a processor coupled to the monitoring subsystem and the communication interface; and a memory coupled to the processor, wherein the memory comprises instructions configured to:

obtain a command to generate the coreflooding simulation data;

generate the coreflooding simulation data; and transmit the coreflooding simulation data using the communication interface.

3. The method of claim 1 further comprising:

obtaining first acquired coreflooding simulation data regarding one or more simulation parameters in real-time during a coreflooding simulation test of the plurality of coreflooding simulations for the core sample;

determining, by the computer processor and based on the coreflooding simulation model, a first coreflooding simulation using the first acquired coreflooding simulation data;

wherein the first coreflooding simulation comprises a real-time simulation of coreflooding the first reservoir at a current set of flooding parameters in the coreflooding simulation test;

determining, by the computer processor, whether the first coreflooding simulation satisfies a predetermined criterion;

determining, by the computer processor and in response to determining that the first coreflooding simulation fails to satisfy the predetermined criterion, replacement simulation parameters for the coreflooding simulation test;

determining, by the computer processor and based on the coreflooding simulation model, a second coreflooding simulation based on using the replacement simulation parameters for the coreflooding simulation test; and transmitting, by the computer processor to the core flood apparatus, a first command to update the coreflooding simulation test to implement the replacement simulation parameters.

4. The method of claim 3, wherein the core sample is disposed in the core flood apparatus disposed in a coreflooding system, wherein obtaining the first acquired coreflooding simulation data comprises introducing the current set of flooding parameters into the core flood apparatus, wherein the first acquired coreflooding simulation data comprises an interaction within the core flood apparatus between the current set of flooding parameters and the core sample, the method further comprising detecting the interaction;

wherein the predetermined criterion corresponds to a predetermined interaction; and the method further comprising:

determining, by the computer processor using the coreflooding simulation model and the predetermined interaction, the second recovery rate; and producing, from a production well coupled to the first reservoir, the hydrocarbons at the second recovery rate.

5. The method of claim 3, wherein the coreflooding study corresponds to a first set of flooding parameters comprising a first core flood fluid tested using the first set of flooding parameters, and wherein the replacement simulation parameters comprise a second set of flooding parameters comprising the adjusted treatment fluid, wherein the second coreflooding simulation corresponds to the adjusted treatment fluid tested using the second set of flooding parameters.

6. The method of claim 3, further comprising:

obtaining historical reservoir data for one or more wells at a predetermined distance from the first reservoir, wherein the coreflooding simulation model uses the historical reservoir data to determine the predetermined criterion.

7. The method of claim 3, further comprising:

determining, by the computer processor and based on the coreflooding simulation model, a third coreflooding simulation based on using the replacement simulation parameters for the coreflooding simulation test;

wherein the replacement simulation parameters comprise a third set of flooding parameters comprising a third core flood fluid, wherein the third coreflooding simulation corresponds to the third core flood fluid tested using the third set of flooding parameters, and transmitting, by the computer processor to the core flood apparatus, a second command to terminate the coreflooding simulation test in response to determining that the third coreflooding simulation fails to satisfy the predetermined criterion.

8. The method of claim 2 further comprising:

inserting the core sample into the sleeve second end of the conformable sleeve;

wherein a core back surface forms a core back surface-surface contact with the core end plug coupled to the sleeve first end of the conformable sleeve;

disposing the core piston into the sleeve second end toward a core front surface;

disposing the core flood fluid into the fluid cell;

disposing the core sample, the conformable sleeve, the core piston, and the core end plug onto the fluid cell;

coupling the core holder body onto the cell body;

wherein a taper sealing element seals between the core end plug and the cell body;

wherein a lip sealing element seals between the core end plug and the core holder body;

pressurizing the confining chamber using a second pump and a confining substance to form a confining pressure;

conforming, using the confining pressure, the conformable sleeve around the core sample to form the core outer surface-surface contact between the sleeve inner surface and the core outer surface;

translating, using the confining pressure, the core piston within the conformable sleeve;

translating, using the core piston, a translatable tube coupled to the core piston;

forming, using the confining pressure, a core front surface-surface contact between the core piston surface of the core piston and the core front surface of the core sample;

applying the confining pressure onto the core sample in both a radial direction and an axial direction;

introducing a hydraulic substance from a hydraulic source into the hydraulic chamber;

pressurizing the hydraulic chamber using a first pump and the hydraulic substance to form a pressurized fluid on a piston hydraulic side of the piston;

displacing the core flood fluid from the treatment fluid cell using the piston and the pressurized fluid;

flowing the core flood fluid through the core sample using the pressurized fluid and the piston; and directing the core flood fluid out the translatable tube into a test fluid receiving tank.

9. The method of claim 1, wherein the coreflooding simulation model is an artificial neural network comprising an input layer, a plurality of hidden layers, and an output layer.

10. The method of claim 4 further comprising:

obtaining training data comprising a plurality of labeled interactions of historical interactions, wherein a respective labeled interaction among the plurality of labeled interactions corresponds to the predetermined interaction; and performing a training operation of the coreflooding simulation model using the training data.

11. An apparatus comprising:

a confining chamber defined by a chamber inner wall of a core holder body, a conformable sleeve, a core end plug sealingly coupled to the core holder body and to the conformable sleeve, and a second end cap sealingly coupled to the core holder body;

wherein the core end plug is configured to couple to a sleeve first end of the conformable sleeve, wherein the conformable sleeve is configured to hold a core sample from a first reservoir of interest such that a core outer surface-surface contact is formed with a sleeve inner surface and a core outer surface, and wherein the conformable sleeve comprises a core piston configured for a sliding fit within the conformable sleeve, wherein the core piston is inserted into the conformable sleeve from a sleeve second end such that a core end surface-surface contact is formed with a core piston surface;

a fluid cell defined by a cell inner wall of a cell body and a first end cap configured to sealingly couple to the cell body;

wherein the fluid cell is configured to sealingly couple to the confining chamber;

a piston translatably disposed in the fluid cell and configured to sealingly divide the fluid cell into a treatment fluid cell and a hydraulic chamber;

a translatable tube coupled to the core piston and configured for a sealing fit between the translatable tube and the second end cap;

a monitoring subsystem coupled to the confining chamber, the hydraulic chamber, and the treatment fluid cell;

wherein the monitoring subsystem is configured for recording coreflooding simulation data;

a communication interface coupled to the monitoring subsystem;

a processor coupled to the monitoring subsystem and the communication interface; and a memory coupled to the processor, wherein the memory comprises instructions configured to perform a method comprising:

obtain a command to generate the coreflooding simulation data;

generate the coreflooding simulation data; and transmit the coreflooding simulation data using the communication interface.

12. The apparatus of claim 11, wherein the confining chamber is configured to apply a confining pressure onto the core sample, wherein the core piston is configured to apply the confining pressure in an axial direction, wherein the conformable sleeve is configured to apply the confining pressure in a radial direction, wherein the piston is configured to displace a core flood fluid from the treatment fluid cell through the core sample, and wherein the translatable tube is configured to translate through the second end cap and to direct the core flood fluid to a test fluid receiving tank, wherein translating the translatable tube corresponds with translating the core piston within the conformable sleeve.

13. The apparatus of claim 11, wherein the communication interface is configured to transmit the coreflooding simulation data to a control system.

14. The apparatus of claim 11, wherein the memory is configured to store the coreflooding simulation data.

15. The apparatus of claim 11, wherein the method further comprises recording the coreflooding simulation data after the apparatus receives the command to generate the coreflooding simulation data, wherein the method further comprises transmitting, using the communication interface, the coreflooding simulation data to a control system.

16. A system comprising:

a core flood apparatus comprising a core holder, a communication interface, a processor, and a memory, wherein the core flood apparatus is configured for holding, using the core holder, a core sample acquired from a first reservoir of interest; wherein the first reservoir is producing hydrocarbons at a first recovery rate;

a control system coupled to the core flood apparatus, wherein the control system comprises a computer processor, the control system comprising functionality for:

performing, by the core flood apparatus, a coreflooding study comprising a plurality of coreflooding simulations using the core sample disposed in the core flood apparatus;

performing, by the computer processor and using a coreflooding simulation model, a reservoir simulation study on the first reservoir using the coreflooding study;

adjusting, by the computer processor, a core flood fluid based on the reservoir simulation study to form an adjusted treatment fluid that produces a second recovery rate from the first reservoir;

wherein the second recovery rate is greater than the first recovery rate; and performing, using an injection well, an injection operation of a reservoir using the adjusted treatment fluid; and wherein the communication interface is configured to transmit coreflooding simulation data to the control system, wherein the memory is configured to store the coreflooding simulation data.

17. The system of claim 16, wherein the control system further comprises functionality for:

obtaining first acquired coreflooding simulation data regarding one or more simulation parameters in real-time during a coreflooding simulation test of the plurality of coreflooding simulations for the core sample;

determining, by the computer processor and based on the coreflooding simulation model, a first coreflooding simulation using the first acquired coreflooding simulation data, wherein the first coreflooding simulation comprises a real-time simulation of coreflooding the first reservoir at a current set of flooding parameters in the coreflooding simulation test;

determining, by the computer processor, whether the first coreflooding simulation satisfies a predetermined criterion;

determining, by the computer processor and in response to determining that the first coreflooding simulation fails to satisfy the predetermined criterion, replacement simulation parameters for the coreflooding simulation test;

determining, by the computer processor and based on the coreflooding simulation model, a second coreflooding simulation based on using the replacement simulation parameters for the coreflooding simulation test; and transmitting, by the computer processor to the core flood apparatus, a first command to update the coreflooding simulation test to implement the replacement simulation parameters.

18. The system of claim 17 further comprising:

a user device coupled to the control system;

wherein the user device is configured to provide a graphical user interface for presenting the first acquired coreflooding simulation data regarding the one or more simulation parameters.

19. The system of claim 18, wherein the first acquired coreflooding simulation data comprises an interaction within the core flood apparatus between the current set of flooding parameters and the core sample, wherein the predetermined criterion corresponds to a predetermined interaction within the core flood apparatus, and wherein the control system further comprises functionality for:

detecting the interaction;

determining, by the computer processor using the coreflooding simulation model and the predetermined interaction, the second recovery rate; and producing, from a production well coupled to the first reservoir, the hydrocarbons at the second recovery rate;

wherein the user device is further configured to:

present the interaction of the first coreflooding simulation fails to satisfy the predetermined interaction, and obtain a user selection of one or more replacement simulation parameters in response to presenting the interaction of the first coreflooding simulation fails to satisfy the predetermined interaction.

20. The system of claim 16 further comprising:

a first pump system coupled to the control system and the core flood apparatus, wherein the first pump system is configured to supply a pressurized fluid from a hydraulic fluid source to a hydraulic chamber of the core flood apparatus, a second pump system coupled to the control system and the core flood apparatus, wherein the second pump system is configured pressurize a confining substance from a confining substance source to supply a confining pressure to a confining chamber of the core flood apparatus, wherein the confining chamber is defined by a chamber inner wall of a core holder body, a conformable sleeve, a core end plug sealingly coupled to the core holder body and to the conformable sleeve, and a second end cap sealingly coupled to the core holder body;

wherein the core end plug is configured to couple to a sleeve first end of the conformable sleeve, wherein the conformable sleeve is configured to hold the core sample such that a core outer surface-surface contact is formed with a sleeve inner surface and a core outer surface, and wherein the conformable sleeve comprises a core piston configured for a sliding fit within the conformable sleeve, wherein the core piston is inserted into the conformable sleeve from a sleeve second end such that a core end surface-surface contact is formed with a core piston surface;

a fluid cell defined by a cell inner wall of a cell body and a first end cap configured to sealingly couple to the cell body;

wherein the fluid cell is configured to sealingly couple to the confining chamber;

a piston translatably disposed in the fluid cell and configured to sealingly divide the fluid cell into a treatment fluid cell and the hydraulic chamber;

a translatable tube coupled to the core piston and configured for a sealing fit between the translatable tube and the second end cap;

a monitoring subsystem coupled to the confining chamber, the hydraulic chamber, and the treatment fluid cell;

wherein the monitoring subsystem is configured for recording the coreflooding simulation data;

wherein the communication interface is coupled to the monitoring subsystem, wherein the processor is coupled to the monitoring subsystem and the communication interface, wherein the memory is coupled to the processor, and the memory comprises instructions configured to perform a method comprising:

obtain a command to generate the coreflooding simulation data;

generate the coreflooding simulation data; and transmit the coreflooding simulation data using the communication interface.

21. The system of claim 20, wherein the confining chamber is configured to apply the confining pressure onto the core sample, wherein the core piston is configured to apply the confining pressure in an axial direction, wherein the conformable sleeve is configured to apply the confining pressure in a radial direction, wherein the piston is configured to displace the core flood fluid from the treatment fluid cell through the core sample, and wherein the translatable tube is configured to translate through the second end cap and to direct the core flood fluid to a test fluid receiving tank, wherein translating the translatable tube corresponds with translating the core piston within the conformable sleeve.

22. The system of claim 20, wherein the method further comprises recording the coreflooding simulation data after the core flood apparatus receives the command to generate the coreflooding simulation data, wherein the method further comprises transmitting, using the communication interface, the coreflooding simulation data to the control system.

23. The system of claim 19:

wherein the control system comprises further functionality for:

obtaining historical reservoir data for one or more wells at a predetermined distance from the first reservoir;

obtaining training data comprising a plurality of labeled interactions of historical interactions, wherein a respective labeled interaction among the plurality of labeled interactions corresponds to the predetermined interaction; and performing a training operation of the coreflooding simulation model using the training data.

* * * * *